US009488360B2

(12) United States Patent
Kadijk et al.

(10) Patent No.: US 9,488,360 B2
(45) Date of Patent: Nov. 8, 2016

(54) LIGHTING DEVICE WITH INTEGRATED LENS HEAT SINK

(71) Applicant: KONINKLIJKE PHILIPS N.V., Eindhoven (NL)

(72) Inventors: Simon Eme Kadijk, Veldhoven (NL); Pieter Johannes Quintus Van Voorst Vader, Son (NL); Peter Johannes Martinus Bukkems, Deurne (NL); Emanuel Nicolaas Hermanus Johannus Stassar, Sprang Capelle (NL); Jonathan David Mason, Waalre (NL); Dzmitry Viktorovich Aliakseyeu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 59 days.

(21) Appl. No.: 14/425,646

(22) PCT Filed: Sep. 6, 2013

(86) PCT No.: PCT/IB2013/058339

§ 371 (c)(1),
(2) Date: Mar. 4, 2015

(87) PCT Pub. No.: WO2014/037908

PCT Pub. Date: Mar. 13, 2014

(65) Prior Publication Data

US 2015/0252996 A1 Sep. 10, 2015

Related U.S. Application Data

(60) Provisional application No. 61/697,921, filed on Sep. 7, 2012.

(51) Int. Cl.
*H05B 37/02* (2006.01)
*F21V 29/70* (2015.01)

(Continued)

(52) U.S. Cl.
CPC ..... *F21V 29/70* (2015.01); *F21K 9/135* (2013.01); *F21K 9/56* (2013.01); *F21V 3/04* (2013.01);

(Continued)

(58) Field of Classification Search
CPC .. H05B 37/02; H05B 33/08; H05B 33/0854; H05B 33/0896
USPC ..... 315/151–153, 187, 291, 307, 308, 309
See application file for complete search history.

(56) References Cited

U.S. PATENT DOCUMENTS

2005/0200262 A1 9/2005 Wu
2009/0034231 A1 2/2009 Chu et al.

(Continued)

FOREIGN PATENT DOCUMENTS

CN 101858495 A 10/2010
GB 2479758 A 10/2011

(Continued)

*Primary Examiner* — Jimmy Vu

(57) ABSTRACT

There is provided a lighting device 100 comprising at least one LED-based light source 102 for generating light, and a light exit element 101 which is optically and thermally coupled to the LED-based light source. The light exit element comprises a heat conducting structure 150 arranged for distributing heat generated by the LED-based light source over a predetermined sub area of the light exit element. The heat conducting structure may be embedded in or thermally connected to the light exit element and comprises aligned heat conducting paths 151. The introduction of heat conductive structures into the light exit element that spread heat in the light exit element and may be arranged to conduct heat from a heat sink into the light exit element or from the light exit element to a heat sink makes the light exit element to an integral part of the heat transferring external surface of the lighting device.

13 Claims, 5 Drawing Sheets

(51) Int. Cl.

| | |
|---|---|
| ***F21K 99/00*** | (2016.01) |
| ***F21V 3/04*** | (2006.01) |
| ***F21V 29/506*** | (2015.01) |
| ***F21V 29/80*** | (2015.01) |
| ***F21V 29/90*** | (2015.01) |
| ***F21V 29/51*** | (2015.01) |
| ***H05B 33/08*** | (2006.01) |
| *F21Y 101/02* | (2006.01) |
| *F21V 29/71* | (2015.01) |

(52) U.S. Cl.

CPC ..... *F21V 29/506* (2015.01); *F21V 29/51* (2015.01); *F21V 29/80* (2015.01); *F21V 29/90* (2015.01); *H05B 33/0815* (2013.01); *H05B 33/0854* (2013.01); *H05B 33/0896* (2013.01); *F21V 29/717* (2015.01); *F21Y 2101/02* (2013.01)

(56) References Cited

U.S. PATENT DOCUMENTS

| | | | |
|---|---|---|---|
| 2011/0032708 | A1 | 2/2011 | Johnston et al. |
| 2011/0080096 | A1 | 4/2011 | Dudik et al. |
| 2011/0095686 | A1 | 4/2011 | Falicoff et al. |
| 2011/0140588 | A1 | 6/2011 | Chen |
| 2011/0298371 | A1 | 12/2011 | Brandes et al. |
| 2011/0305025 | A1 | 12/2011 | Loveland |
| 2012/0081880 | A1 | 4/2012 | Narendran et al. |
| 2012/0201031 | A1 | 8/2012 | Marley |

FOREIGN PATENT DOCUMENTS

| | | | |
|---|---|---|---|
| JP | 2008135260 | A | 6/2008 |
| JP | 2010231913 | A | 10/2010 |
| JP | 2011159825 | A | 8/2011 |
| WO | 2010144572 | A2 | 12/2010 |

LIGHTING DEVICE WITH INTEGRATED LENS HEAT SINK

CROSS-REFERENCE TO PRIOR APPLICATIONS

This application is the U.S. National Phase application under 35 U.S.C. §371 of International Application No. PCT/IB13/058339, filed on Sep. 6, 2013, which claims the benefit of U.S. Provisional Patent Application No. 61/697,921, filed on Sep. 7, 2012. These applications are hereby incorporated by reference herein.

TECHNICAL FIELD

The present invention relates to the field of thermal management of lighting devices, and more particularly to light emitting diode (LED) based lighting devices configured to provide thermal management utilizing a light exit element of the lighting device as a heat spreader.

BACKGROUND OF THE INVENTION

LED based lighting devices, or LED lamps, have become common on the market and are showing great promise to gradually replace incandescent and compact fluorescent lamps throughout the world due to long life-time expectancy, reduced size, and high energy-efficiency with respect to energy and lumen output efficiency as compared to for instance traditional incandescent light bulbs. Utilizing LED based lamps in traffic lights, a city can significantly reduce the energy related cost per year per signal, because a LED lamp uses approximately one-tenth of the electricity that the traditionally used illumination does.

Thermal management of LED lamps is key, since the performance of the LED lamp is often limited in the light output by thermal constraints. Thermal management may be concerned with managing heat produced by the LED lamp itself, as well as external heat sources, or may be related to influence on the LED lamp by the ambient temperature. Generally, the thermal performance determines the maximum light output from the LED lamp, and is further determined mainly by the size of the heated external surface of the LED lamp. As an example, consider a typical retrofit LED lamp comprising at least one LED-based light source arranged in thermal contact with a heat sink, i.e. typically the lamp base. The LED-based light source is arranged for generating light which exits the LED lamp through a light exit element, i.e. an optically transmissive element like for instance a bulb envelope. The light exit element is typically made of a transparent or translucent material, like glass, silicone, and Polycarbonate, PC, which materials all have a low thermal conductance. Therefore heat spreading from the heat sink into the bulb envelope is not effective, and most of the heat produced by the LEDs therefore exits the lighting device via the heat sink.

It is known in the art to increase the heated external surface of the LED lamp by means of providing heat spreading from the heat sink to the light exit element. WO2010/097721 A1 discloses a LED lamp including a LED-based light source configured to emit light and an optically transmissive window optically and thermally coupled to the LED-based light source. Different solutions for configuring the optically transmissive window to in an improved manner radiate heat generated by the LED-based light source to the ambient, as compared to the typical prior art LED lamp as described above, are shown. For instance, the document discloses the optically transmissive window being arranged with one of a coating with predetermined heat conductivity, a compound material, an at least partly integral heat pipe, and a combination of elements including two materials with different thermal conductivities.

SUMMARY OF THE INVENTION

In view of the above, an object of the invention is to at least provide an advantageous and alternative solution to thermally control a LED based lighting device by utilizing the light exit element to distribute heat generated by the LED-based light source.

This object is achieved by a lighting device according to the present invention as defined in claim 1. Thus, in accordance with an aspect of the present invention, there is provided a lighting device comprising at least one LED-based light source for generating light, and a light exit element being optically and thermally coupled to the LED-based light source. The light exit element comprises a heat conducting structure arranged for distributing heat generated by the at least one LED-based light source over at least a predetermined sub area of the light exit element. The heat conducting structure may be embedded in, or in physical contact with, or in close proximity to the light exit element, and comprises a set of aligned heat conducting paths. In preferred embodiments of the lighting device, the heat conducting structure comprises heat conducting wires, or a thin patterned heat conducting layer, which both provide simple, yet efficient heat conducting structures which are suitable to be arranged at or embedded in the light exit element without a big influence on the light transmission through the light exit element.

The present inventive concept is based on introducing a heat conducting structure at the light exit element, which conducts heat and effectively spreads the heat over the light exit element and decreases the thermal gradient in the light exit window, and the lighting device overall. The light exit element becomes an integral part of the heat transferring external surface of the lighting device, which increases the possibility to thermally control the lighting device. By utilising the light exit element as an extra heat sink area, the lighting device can take on a more free form factor as compared to traditional LED lighting devices in which the LED heat sink typically occupies a major part of the device.

According to the present inventive concept, the heat conducting structure is advantageously arranged as aligned heat conducting paths/tracks which may be embedded in the light exit window. According to an embodiment of the lighting device, the heat conducting structure comprises a set of heat conductive wires, or is a patterned heat conducting film. The wires or branches of the pattern may be aligned in a predetermined manner to facilitate heat conduction in a predetermined direction or a predetermined distribution within light exit element. There is an advantage of using aligned heat conducting structures over any other heat conducting structure, which is associated with an optimum anisotropy in the thermal conductivity that is obtained in the light exit element. This is needed e.g. if the wires (or patterned branches) are opaque. As an example, a typical light exit element of a LED lamp has a diameter of 5-20 cm, or has a distance from the heat sink of approximately 2.5-10 cm from the heat sink to the centre of the light exit element. Therefore, large thermal gradients occur in the light exit element if the heat spreading from the heat sink to the light exit element is low. When using opaque wire (branch) materials, the opaque wire structure will deteriorate the optical properties of the light exit element, even if the wires are provided with a highly reflective coating, as in some embodiments of the present invention. Maximum heat conduction with minimum material use is wanted for that reason, and this is obtained by arranging the heat conduction material in separate heat conducting paths.

According to an embodiment of the lighting device, at least a main portion of the heat conductive wires or branches of the pattern of the patterned heat conducting film are arranged to transfer heat in a substantially radial direction with respect to the centre of the light exit element. In order to maximize the heat flow in a radial direction with respect to the window centre, maximum thermal anisotropy arranged by alignment of the wires in a radial direction with respect to the centre of the light exit element is the most advantageous solution.

According to embodiments of the lighting device, the spacing between adjacent wires or branches is selected in a range of 5-15 mm, which is advantageous for obtaining optimum uniformity of the temperature distribution in the light exit element. However, a wider spacing between wires or branches may be used if a minimal optical disturbance of the lighting device is required.

According to embodiments of the lighting device, the heat conducting structure may further comprise interconnecting wires or branches between adjacent wires or branches, respectively, thereby providing a meshed heat conducting structure. The interconnecting wires may be added to provide rigidity of the heat conducting structure which may be advantageous during manufacturing or which provides support for the finished light exit element. Further, if the interconnecting wires are heat conductive, the heat spreading within the light exit element is increased.

According to an embodiment of the lighting device, it further comprises a coupling element arranged for thermally coupling the light exit element and the at least one LED-based light source. The coupling element may be at least one heat pipe, a vapour chamber, or at least one heat conductive wire.

The thermal control of the lighting device arrangement according to the first aspect of the present inventive concept, is further applicable for preventing overheating of remote phosphor domes, and for providing an improved mechanical rigidity of small remote phosphor domes. The application of a remote phosphor dome on top of a blue pump LED is a well known method with a relatively high optical efficiency to produce white light. Due to energy loss related to Stokes shift and overall efficiency losses during the down conversion process of blue light (which blue light is produced by the blue pump LED) to yellow light in the phosphor material of the phosphor dome, the remote phosphor dome heats up. An increase in temperature typically leads to decreased lumen performance and an overheated remote phosphor dome. By applying the present inventive concept of a heat conducting structure in the remote phosphor dome, i.e. the light exit element of the lighting device, heat is distributed within the light exit element, and may further be transferred to an overall lamp heat sink of the lighting device, which significantly lowers the internal temperature of the remote phosphor dome.

According to an embodiment of the lighting device, the LED-based light source is a remote phosphor light source comprising a primary LED-based light source and a down conversion phosphor material arranged at the light exit element.

According to an embodiment of the lighting device, it further comprises a heat sink thermally coupled to the light exit element and/or the LED-based light source.

According to the first aspect of the present inventive concept, spreading the heat generated by the LED-based light sources within the light exit element, is in addition to the above, advantageous for outdoor lighting applications in countries having a colder climate or indoor applications in cold environments, such as large walk in freezers, freezer cabinets, ice rinks, sheds and outhouses which in the winter can become freezing inside etc. Since the light output from LEDs is not hot, unlike the output from a halogen lamp for example, ice formation on the light exit element, i.e. the lens of the LED lamp, can occur and obscure the light output from the lighting device. Many countries having a colder climate are less interested in LED lighting in outdoor applications, because the traditional incandescent lamps do not have this problem. By utilizing that the light exit element operates as a heat sink, rather than distributing the heat via a heat sink arranged on the backside of the LED carrier substrate as is traditional, the heat generated by the LEDs can be used to thermally manage the light exit window, and for instance to prevent ice from forming on the lens.

According to an embodiment of the lighting device, it further comprises a temperature sensor and/or timer arranged in communication with a control means for thermally controlling the light exit element by means of a control signal associated with a driving power of the LED-based light source. The control signal may provide one of a pulsed switching of the LED-based light source at a frequency which is undetectable by the human eye but sufficient to heat the light exit element, or a driving power of the LED-based light source selected to provide a light output level from the LED-based light source which is undetectable by the human eye but sufficient to heat the light exit element. Further, a system for thermally controlling a lighting device according to the present invention is disclosed herein in the detailed description.

According to another aspect of the invention, there is provided a method for thermally controlling a lighting device according to the present inventive concept when comprising a temperature sensor and/or a timer comprising:

- receiving a temperature reading from the temperature sensor, and/or
- receiving a timer signal from the timer, and
- based on the temperature reading and/or the timer signal:
- providing a control signal associated with a driving power of the LED-based light source.

The control signal may provide one of a pulsed switching of the LED-based light source at a frequency which is undetectable by the human eye but sufficient to heat the light exit element, or a driving power of the LED-based light source selected to provide a light output level from the LED-based light source which is undetectable by the human eye but sufficient to heat the light exit element.

The term LED-based light source includes any light source comprising electroluminescent light generating systems, thus including various semiconductor-based structures that emit light in response to current, light emitting polymers, organic light emitting diodes (OLEDs), electroluminescent strips, etc. Further, a LED-based light source may include LED dies, LED chips, and/or LED packages.

Other objectives, features and advantages will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1A:
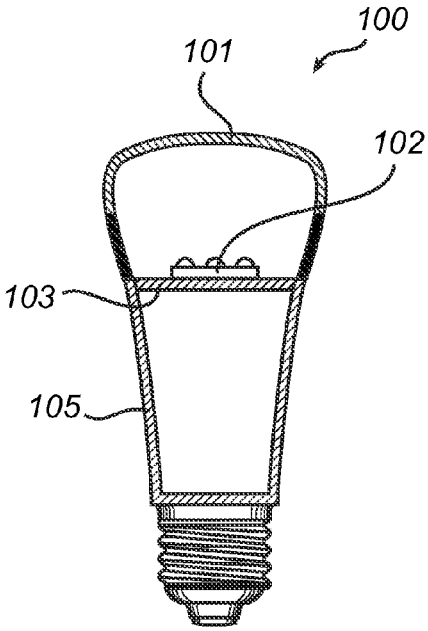
FIG. 1*a*) shows a cross-sectional view of an embodiment of a lighting device according to the present inventive concept, FIG. 1*b*) shows a partly cut open side view of a light exit element according to the lighting device shown in FIG. 1*a*), FIG. 1*c*) and *d*) illustrate an embodiment of a lighting device according to the present inventive concept, FIG. 2*a*)-*d*) show thermal simulations performed in an ANSYS CFX modelling environment for exemplifying embodiments according to the present inventive concept, FIG. 3*a*) is a partly cut open side view illustration of an embodiments of a lighting device according to the present inventive concept, and FIG. 3*b*) shows a cut open side view of a light exit element according to the lighting device shown in FIG. 3*a*), FIGS. 4*a*)-*d*) are cross sectional side views illustrating a prior art lighting device and embodiments of a lighting device according to the present inventive concept.

An embodiment of a lighting device according to the present inventive concept is now described with reference to FIG. 1*a*). The shown lighting device is here a retrofit LED based lamp 100 comprising LED-based light sources 102 arranged on a substrate 103 which is thermally connected to a heat sink, here in the form of a lamp base 105. The LED lamp 100 is further provided with drive circuitry arranged on the substrate and/or in the lamp base (not shown). A bulb envelope 101 constitutes a light exit element for the LED based lamp 100. According to embodiments, the LED lamp may further comprise control circuits to control the light output and/or to provide thermal management of LED lamp as will be described herein under.

Figure 1B:
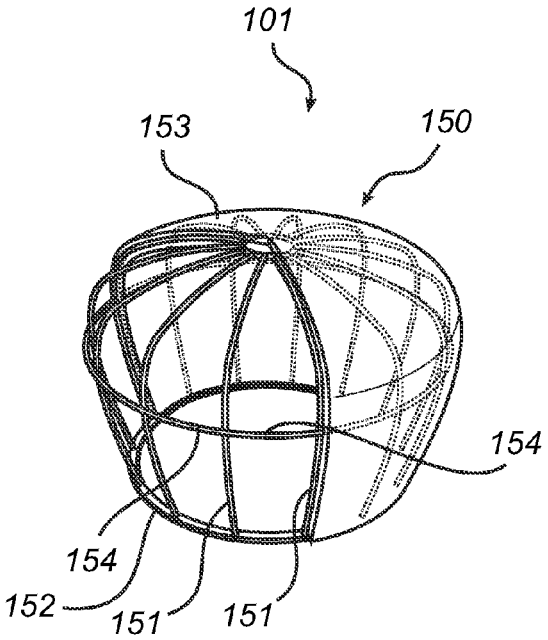

According to the present inventive concept, the light exit element of a lighting device, such as the retrofit LED lamp 100 described with reference to FIG. 1*a*), is provided with a heat conducting structure arranged for distributing heat generated by the LED-based light sources over at least a subarea of the light exit element. The heat conducting structure is embedded in the light exit element. Alternatively, the heat conducting structure may be arranged in physical contact with, or in close proximity to the light exit element. In FIG. 1*b*) the bulb envelope 101 of the LED lamp 100 is illustrated in more detail. The bulb envelope 101 comprises a light transmissive material layer 153, e.g. silicone, in which a heat conducting structure 150 is embedded. The heat conducting structure 150 here comprises thin heat conductive wires 151, which are oriented to extend from the lower end of the bulb envelope 101, which when mounted is arranged at the heat sink, i.e. lamp base 105, and within the wall of the bulb envelope 101 towards a top centre of the bulb envelope 101. In this exemplifying embodiment, the wires are arranged in a star like configuration relative to the top centre of the bulb envelope 101, such that adjacent wires are not completely parallel relative to each other, but aligned to transfer heat in a radial direction with reference to the top centre of the bulb envelope. Depending on the shape of the envelope, the wires may be aligned differently. The heat conductive wires 151 are thermally connected to a supporting thermally conducting support ring 152 made of aluminum or any other applicable thermally conductive material (optional). The support ring 152 is further mechanically and thermally attached to the heat sink, lamp base 105.

Optionally, the set of thermally conductive wires 151 are interconnected by supporting wires 154 to create rigidity in a mesh like configuration, as illustrated in FIG. 1*b*). The supporting wires 154 may be provided in a heat conductive material or some other applicable material. Preferably, the heat conductive wires of the heat conducting structure are selected to have a rectangular cross section. Other shapes of the cross section are applicable, e.g. circular, square etc. The thermally conductive wires are preferably made of one of Aluminum, and Copper, but other applicable heat conducting materials may be used. When utilizing heat conductive wires with a rectangular cross section, the wires are optionally arranged having the thinner side arranged against the direct light from the light source, thereby reducing the blockage of light by the heat conductive wires. Preferably, the thickness of the wires is selected between 0.5-2.0 mm. Preferably, the heat conductive wires are arranged having an interspacing of 5-15 mm.

Figure 1C:
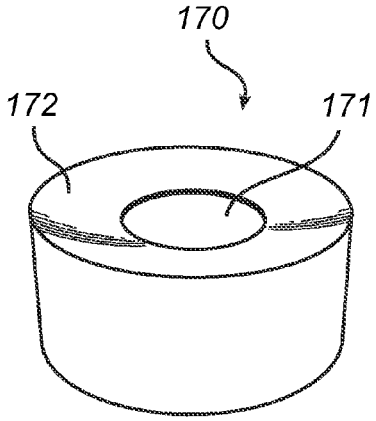
Figure 1D:
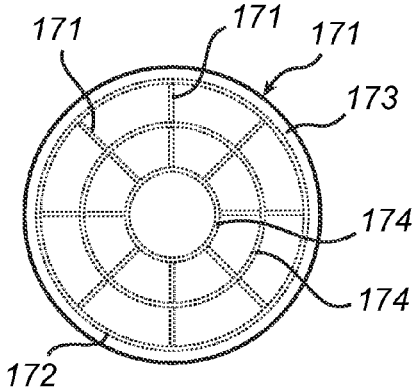

FIG. 1*c*) and *d*) illustrate an embodiment of a LED lamp according to the present invention in the form of a LEDisk 170, which comprises a housing 172, in which a LED-based light source is arranged and thermally coupled to a heat sink, e.g. the housing, (not shown). The LEDisk 170 further comprises a light exit element 171, which is shown in more detail in a see through top view in FIG. 1*d*). The light exit element 171 comprises an optically transmissive material 173 in which a set of heat conductive wires 171 are radially arranged to spread heat within the light exit window 173. Circumferentially the heat conductive wires are attached to a heat conducting support ring 172, and supporting wires 174 are (optionally) arranged between the heat conductive wires 171.

A LED lamp with wired light exit element 150, 171, as described above with reference to FIG. 1, can be manufactured by providing a support ring made of e.g. Aluminum, attaching a set of heat conductive wires, made of e.g. Aluminum, which are optionally provided with supporting wires such that a meshed structure is achieved. Optionally, the heat conductive wires and the support ring are then subsequently coated with a high reflective white material (not shown). Further, a light transmissive material layer, like plastics or silicone, is then molded around the heat conductive wires, to completely cover the heat conductive wires. Thereafter, the support ring (or light exit element) is clamped, screwed or glued onto the heat sink of LED lamp. Optionally, instead of, or in addition to attaching the light exit element to the heat sink, the light exit element is thermally coupled to the light source via a coupling element as is described further below with reference to FIGS. 4*b*)-4*d*).

According to an embodiment of the wired light exit element of the invention, a characteristic length of heat spreading within the light exit element, at a right angle from the heat conductive wires, is 4-7 mm effectively. As this is at both sides of the heat conductive wires, the effective, or characteristic heated zone per wire is typically 8-14 mm of width. The thickness of the light exit element is generally selected to be more than 1 mm to completely cover the heat conductive wires. Further, an effective length of the heat conductive wires into the light exit element is restricted, and is defined by the cross section of the wire and the wire spacing. As an example, for a wire diameter of 1 mm in Aluminum, and an interspacing of the wires of 10 mm, the effective length is 35-55 mm (depending on the heat transfer effectiveness at the light exit element). This effective length is applicable for heating up the complete dome or bulb envelope of e.g. a typical retrofit LED lamp. If the complete dome or bulb envelope is heated to the same temperature as the heat sink (when present), the thermal performance, expressed in the thermal resistance from heat spreader to ambient, $R_{th_spr\text{-}amb}$, is considerably reduced. In an exemplifying embodiment $R_{th_spr\text{-}amb}$ decreases from 9.5 K/W to 5.5 K/W when introducing heat conductive wires in the light exit element in a free ambient bulb environment. For more examples, see Table 1 below.

In FIG. 2, thermal simulations of LED lamps using ANSYS CFX modeling are illustrated. Note that each bulb temperature graph has a different scale and that the vertical distribution of temperature zones on each bulb substantially corresponds to the vertical distribution of bulb temperature graph. Thermal simulations were performed for a LED lamp with a regular silicone bulb envelope and for LED lamps comprising wired silicone bulb envelopes according to embodiments of the present invention. The wired silicone bulb envelopes were each simulated having different sets of aligned 1 mm heat conductive wires (Al, Cu) arranged to transfer heat in a radial direction with respect to the top centre of the bulb envelope, and fully immersed in its respective silicone bulb envelope. Further, the regular and the wired bulb envelopes were all simulated as being connected to the LED lamp heat sink via a support ring.

Figure 2A:
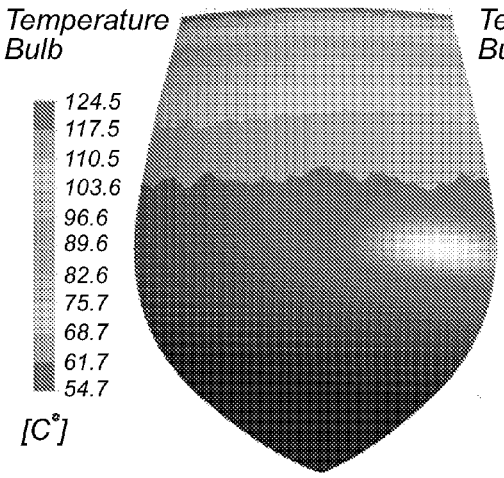
Figure 2B:
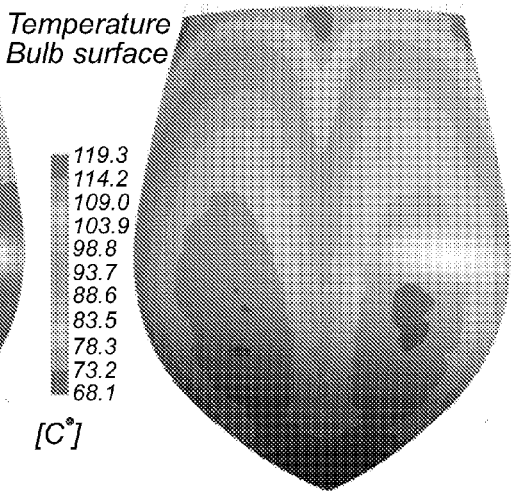
Figure 2C:
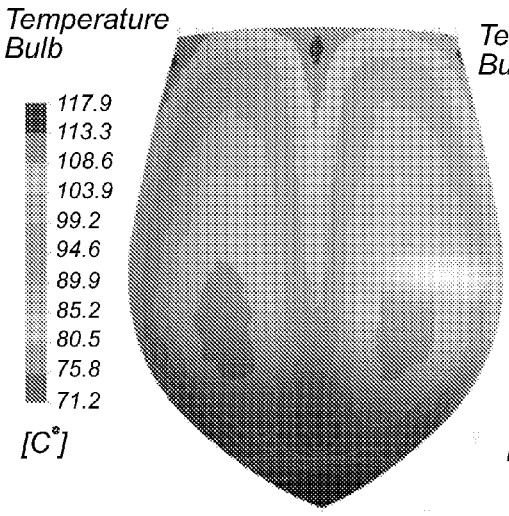

FIG. 2*a*) illustrates the temperature distribution for a regular bulb envelope without heat conductive wires. A high thermal gradient occurs at the upper rim of the silicone bulb due to the poor distribution of heat from the heat sink. The maximum temperature at the rim of the bulb is 124.5° C. In FIGS. 2*b*) and 2*c*) twelve Aluminum wires and twelve Copper wires, respectively, are arranged in the silicone bulb. This increases the heat spreading in the bulb envelope and decreases the maximum temperature on the bulb to 119.3° C. and 117.9° C., respectively.

Figure 2D:
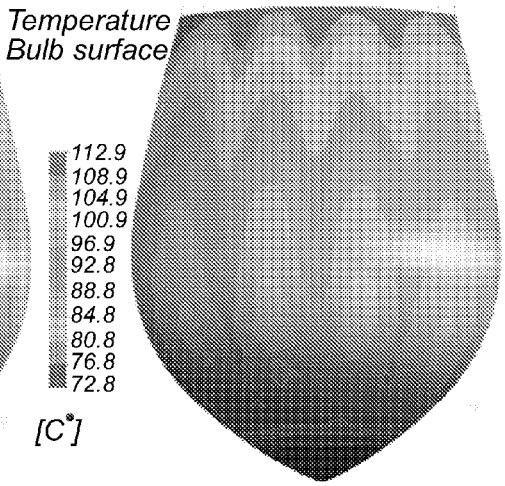

The simulated temperature distribution in a bulb envelope comprising twenty-four Aluminum wires is illustrated in FIG. 2*d*), where it can be noted that the distribution of heat in the bulb envelope is considerably smoothened over the silicon bulb compared to e.g. the regular bulb, and the maximum temperature on the bulb is decreased to 112.9° C.

Table 1 illustrates the simulated thermal resistance $R_{th}$ in a 10 mm sleeve of the bulb envelope for the regular bulb envelope with no wires, and the wired bulb envelopes with twelve Aluminum wires, twelve Copper wires, and twenty-four Aluminum wires, respectively, at 14.8 W load of the LED lamp at an ambient temperature $T_{amb}$25° C. The diameter of the wires was set to 1 mm. The simulated values for the thermal resistance heat spreader to ambient, $R_{th_spre\text{-}amb}$, and the difference in thermal resistance $\Delta R_{th}$ between the regular bulb envelope with no wires, and the wired bulb envelopes with twelve Aluminum wires, twelve Copper wires, and twenty-four Aluminum wires, respectively, are given in the Table.

TABLE 1

| $R_{th}$ (K/W) | No wires | 12 Al | 12 Cu | 24 Al |
|---|---|---|---|---|
| $R_{th_spre\text{-}amb}$ | 8.3 | 7.3 | 6.9 | 6.7 |
| $\Delta R_{th}$ | — | 1.0 | 1.4 | 1.6 |

According to an embodiment of the lighting device, the heat conducting structure in the light exit element is provided as a patterned heat conducting film embedded in the light transmissive material of the light exit element (not shown). Preferably, the pattern of the heat conducting film is arranged as branches arranged to transfer heat in a substantially radial direction with respect to the centre of the light exit element. The spacing between adjacent branches is preferably selected in a range of 5-15 mm. As in the case with wires, interconnecting branches between adjacent branches can optionally be provided in the pattern, such that the heat conducting structure becomes a mesh.

According to an embodiment of the invention, the heat conducting structure is arranged as a honeycomb structure (not shown). Preferably, the honey comb structure is selected to be very open to provide a high anisotropy in the heat conductivity on the scale of every honey comb cell. The anisotropy is advantageous for providing heat distribution over the light exit element area.

According to embodiments of the invention, to optimize the optical behavior of the LED lamp, the external surface of the heat conducting structure is provided with an optically reflective and/or diffuse surface having a high reflectivity index (not shown).

According to an embodiment of the lighting device according to the present invention, which will now be described with reference to FIG. 3, the LED-based light source of the lighting device includes a primary LED-based light source and a light conversion material, like a remote phosphor LED which comprises a down conversing phosphor layer. The down conversion material is typically disposed within the bulb envelope of the lighting device, i.e. within the light exit element, remote from the primary light emitting diode, LED. The light exit element is as previously described provided with a heat conducting structure. A light exit element provided with a down conversion material is typically referred to as a remote phosphor bulb.

Figure 3A:
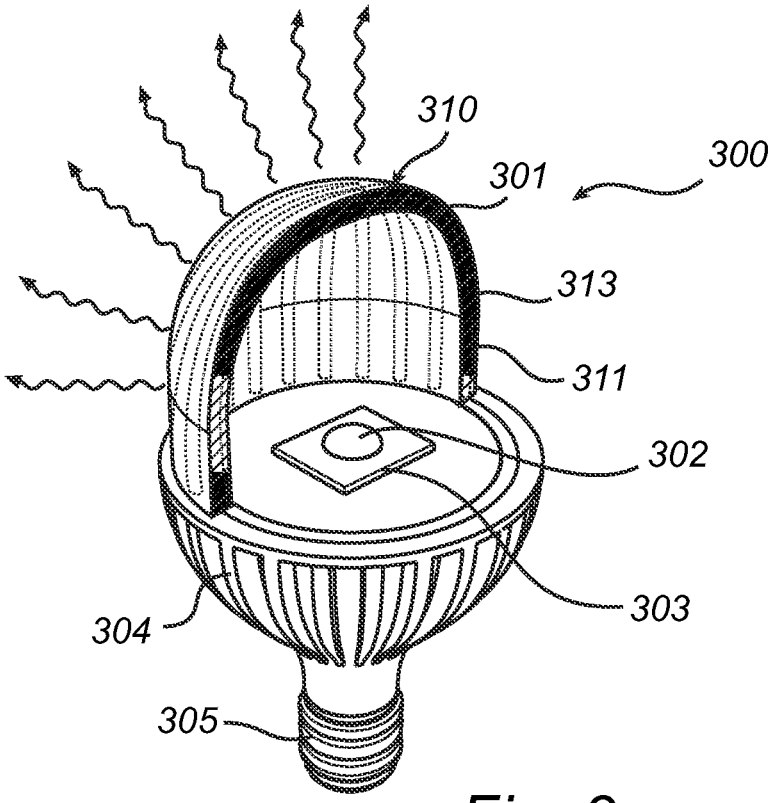
Figure 3B:
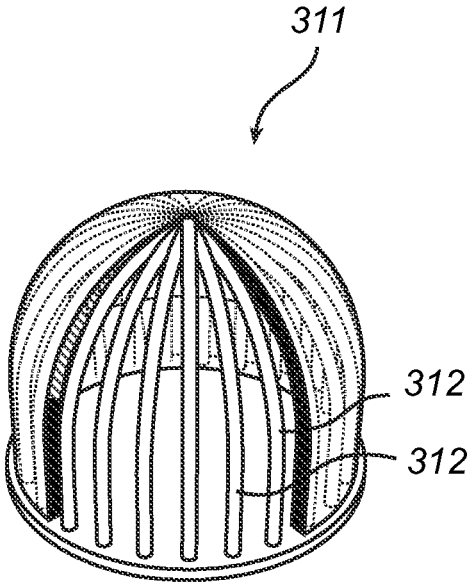

To continue with reference to FIG. 3*a*), in the remote phosphor bulb, here lighting device 300, the LED-based light source comprises a blue pump LED-based light source 302, here a high efficiency blue pump LED, arranged on a substrate 303 and the remote down conversion material, phosphor layer 301, arranged on an inner surface of the remote phosphor bulb 310. Alternatively, the phosphor is distributed in the optically transmissive material 313 of the light exit element, e.g. a suitable plastic material. The lighting device 300 further comprises a lamp base 305 and a heat sink 304, the latter which is thermally coupled to the blue pump LED-based light source 302 and to a lower rim of the remote phosphor bulb 310. The remote phosphor bulb 310 comprises an embedded heat conducting structure 311, which is shown in more detail in FIG. 3*b*). In this exemplifying example, the heat conducting structure 311 comprises 1 mm thick copper wires 312 which are oriented to transfer heat in a substantially radial direction with respect to the centre of the remote phosphor bulb 310. The separation between, or spacing between, adjacent wires is preferably selected in a range of 5-15 mm. The heat conducting structure may optionally be arranged with interconnecting wires or branches between adjacent wires (not shown), thereby providing a meshed heat conducting structure. The heat conductive wire structure 311 is thermally coupled to the heat sink 304 of the lighting device 300 via a support ring.

The introduction of heat conductive structures into the light exit element that conduct heat from the heat sink into the light exit element, as in the embodiments of the lighting device described above with reference to FIGS. 1 and 2, or from the light exit element to the heat sink, as in the embodiment of the lighting device described above with reference to FIG. 3, turns the light exit element to an integral part of the heat transferring external surface of the lighting device. The cooling of the lighting device thus becomes more effective such that the maximum light output of the LED-based light sources is increased. According to embodiments of the lighting device, for increased heat transfer in the light exit element, the transmissive material is preferably a heat conducting glass (e.g. Aluminium or Lithium Ion glass) or heat conducting plastics.

Referring now to FIG. 4, according to embodiments of the invention, thermally controlling the lighting device is directed to providing a controlled temperature of the light exit element, e.g. to prevent ice formation on the light exit element on outdoor mounted lighting devices in colder climates or during the winter months. FIG. 4*a*) illustrates a typical prior art LED lighting device 490 comprising LED-based light sources 402 arranged on a substrate 493 connected to a traditional heat sink arranged on a backside thereof (not shown), and a glass lens 491 arranged as a light exit element. The LED-based light sources 402 are thermally connected to the heat sink 493, such that the heat generated by the LEDs 402 when activated exits the LED lighting device 490 via the substrate 493 to the heat sink, see heat flow illustration A→B in FIG. 4*a*). Since the heat flow is substantially directed away from the lens 491, on cold days an ice layer 90 may be formed on the external surface of the lens 491, as illustrated in the Figure.

Figure 4A:
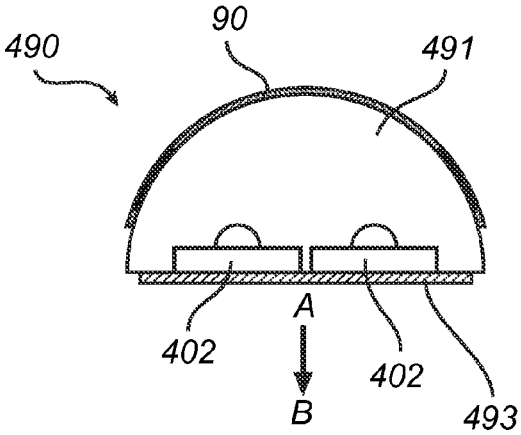
Figure 4B:
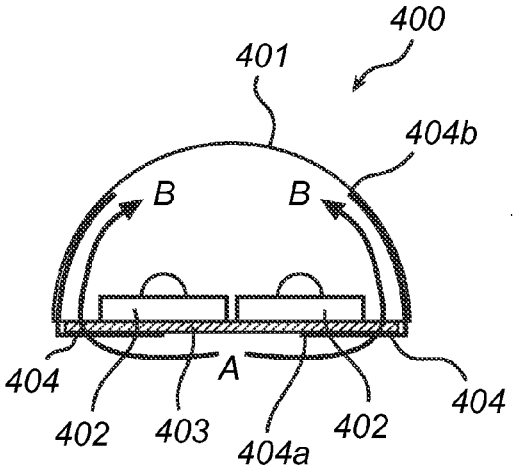

In an embodiment of a LED lighting device 400 according to the present invention, see FIG. 4*b*), LED-based light sources 402 are arranged on a substrate 403 which acts as a heat transfer element. A light exit element 401 in which a heat conducting structure is embedded, as described in various embodiments above, is arranged on top of the substrate 403. The LED-based light sources 402 and the heat conducting structure in the light exit element 401 are thermally coupled via the substrate 403 and a heat coupling element, such that heat generated by the LED-based light sources 402, when in operation, is transferred to the light exit element 401. Here the heat coupling element comprises multiple heat conductive wires 404 arranged between the LED-based light sources 402 (and/or the substrate 403) and the light exit element 401, see heat flow illustration from point A→B in FIG. 4*b*). The actual attachment of the heat coupling element, here wires 404, to the LED-based light sources 402/substrate 403 will depend on the configuration of the LED-based light sources. The wires are mechanically and thermally connected either to the rim, the outside or inside of the light exit element e.g. by means of heat conducting glue or by welding. Suitable materials for the heat conductive wires are copper and aluminium, although other heat conductive materials are applicable.

In a preferred embodiment, at an end portion 404*b* of each heat conductive wire 404, which end portion 404*b* is arranged at the light exit window 401, and where heat should be released, the wires 404 are substantially uninsulated, while at the opposite end portion 404*a* which is closer to the LED-based light sources 402 (heat sources), to avoid heating the substrate 403, the heat conductive wires 404 are at least partly provided with an insulating layer (not shown). The insulating layer can be a polymer coating, see for instance patent U.S. Pat. No. 5,232,737, "Method of coating a metal wire with a temperature and stress resistant polymeric coating". The heat conductive wires 404 are in an embodiment attached to the edge of the light exit element 401 by means of heat conducting glue.

Figure 4C:
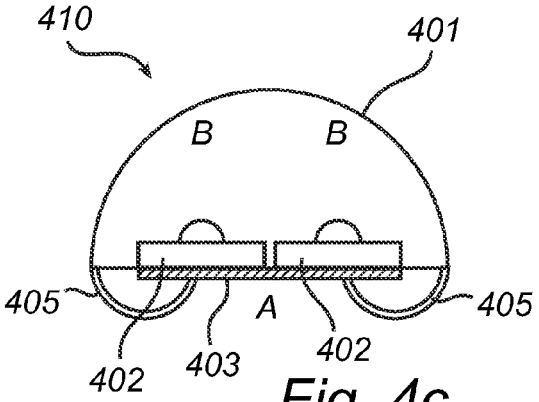
Figure 4D:
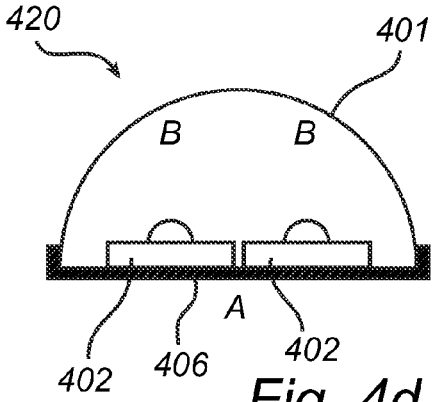

Referring now to FIGS. 4*c*) and 4*d*) in embodiments of a LED lighting device 410, 420 heat pipes 405, 406 are used as a coupling element to thermally couple the LED-based light sources 402 or the substrate 403 on which they are arranged with the light exit element 401. In FIG. 4*c*) LED-based light sources 402 are arranged on a substrate 403, and the substrate 403 and the light exit element 401 are here thermally coupled by means of heat pipes 405. In FIG. 4*d*) flat heat pipes 406 are arranged on the substrate to thermally couple the light exit element and the light sources 402. According to an embodiment, the coupling member is arranged as a vapour chamber (not shown).

Figure 5:
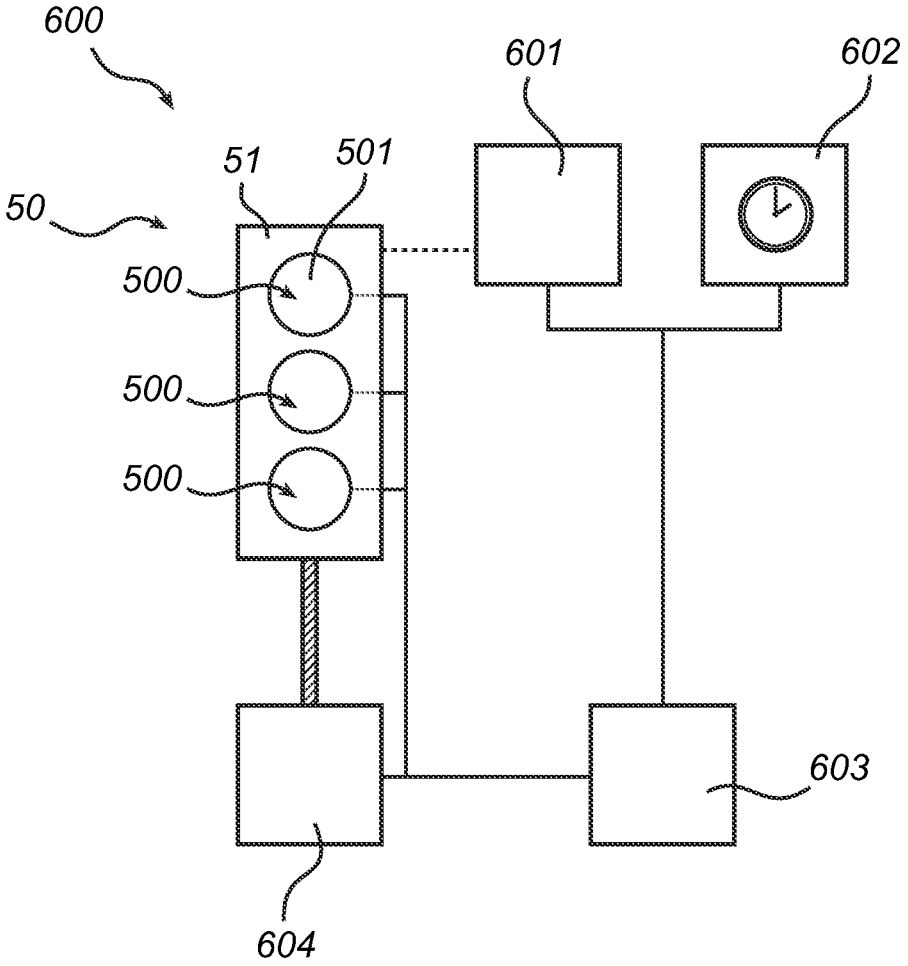
FIG. 5 is a schematic illustration of an embodiment of a system for thermally controlling lighting devices according to the present inventive concept.

Lighting devices according to the present invention are applicable in outdoor applications like for instance traffic lights. As previously mentioned, in situations when the lighting devices in outdoor applications (or applications in cold indoor environments) are not activated for a long time, or when the environment is very cold, ice may form on the light exit elements. Referring now to FIG. 5, which schematically illustrates a system 600 for thermally controlling lighting a traffic light 50 comprising embodiments 500 of the lighting device according to the present invention. The system 600 further comprises at least one temperature sensor 601 and/or a timer 602 contained within or arranged in communication with a control unit 603 arranged for thermally controlling light exit elements 501 of the respective lighting device 500. The control unit 603 may be external to or integrated with a driving unit 604 of the traffic light 50. The control unit comprises applicable control components (hardwired and/or software components) arranged for thermally controlling the lighting devices. The control unit, the temperature sensor and the timer may all be placed within a housing 51 of the traffic light 50. A respective temperature sensor may be arranged at the light exit window 501 of each lighting device 500 (or at least one of the lighting devices) to provide an measured temperature thereof, or a temperature sensor can simply be arranged to measure the ambient temperature. The control unit 603 is arranged to, based on the measured temperature or based on the timer 602, or a combination of the measured temperature and the timer 602, provide a control signal to the individual lighting devices 500 such that they are heated by transferring a controlled amount of heat into the heat conducting structure of the light exit element, as previously described for embodiments of the lighting device according to the present inventive concept. However, the thermal control of the light exit element is preferably provided without producing visible light. When the traffic light is red, only the bottom lighting device is turned on. The yellow and the green lighting devices then need to be thermally controlled. In one embodiment, the thermal control is provided by means of driving the lighting devices at a low unperceivable power level to produce heat, while not producing any visible light. In an alternative embodiment of the system, the individual lighting devices 500 are pulse driven to produce heat in the light exit element 501 to hinder ice formation at a frequency which is unperceivable for the human eye.

Although a traffic light is given as an exemplifying embodiment above, it should be recognized that the present inventive concept is applicable in other lighting applications.

The invention has mainly been described above with reference to a few embodiments. However, as is readily appreciated by a person skilled in the art, other embodiments than the ones disclosed above are equally possible within the scope of the invention, as defined by the appended claims.

The invention claimed is:

1. A lighting device comprising at least one LED-based light source for generating light, and a light exit element being optically and thermally coupled to the LED-based light source, wherein the light exit element comprises a heat conducting structure arranged for distributing heat generated by said at least one LED-based light source over at least a predetermined sub area of said light exit element, wherein said heat conducting structure comprises a set of aligned heat conducting paths, wherein said heat conducting structure is embedded in said light exit element, wherein said heat conducting structure is one of a set of heat conductive wires, or is a patterened heat conducting film comprising wires or branches.

2. The lighting device according to claim 1, wherein at least a portion of said heat conductive wires or branches of the pattern of the patterned heat conducting film are arranged to transfer heat in a substantially radial direction with respect to the centre of the light exit element.

3. The lighting device according to claim 2, wherein the spacing between adjacent wires or branches is selected in a range of 5-15 mm.

4. The lighting device according to claim 3 , further comprising interconnecting wires or branches between adjacent wires or branches, respectively, thereby providing a meshed heat conducting structure.

5. The lighting device according to claim 1, further comprising a coupling element, arranged for thermally coupling said light exit element and said at least one LED-based light source.

6. The lighting device according to claim 5, wherein said coupling element is at least one heat pipe, a vapour chamber, or at least one heat conductive wire.

7. The lighting device according to claim 6, wherein said LED-based light source is a remote phosphor light source comprising a primary LED-based light source and a down conversion phosphor material arranged at said light exit element.

8. The lighting device according to claim 7, further comprising a heat sink thermally coupled to said light exit element and/or said LED-based light source.

9. The lighting device according to claim 8, further comprising a temperature sensor and/or timer arranged in communication with a control means for thermally controlling the light exit element by means of a control signal associated with a driving power of said LED-based light source.

10. The lighting device according to claim 9, wherein said control signal provides one of a pulsed switching of the LED-based light source at a frequency which is undetectable by the human eye but sufficient to heat the light exit element, or a driving power of the LED-based light source selected to provide a light output level from said LED-based light source which is undetectable by the human eye but sufficient to heat the light exit element.

11. A method for a lighting device according to claim 9, comprising:

receiving a temperature reading from said temperature sensor, and/or receiving a timer signal from said timer, and based on said temperature reading and/or said timer signal:

providing said control signal associated with a driving power of said LED-based light source.

12. The method according to claim 11, wherein said control signal provides one of a pulsed switching of the LED-based light source at a frequency which is undetectable by the human eye but sufficient to heat the light exit element, or a driving power of the LED-based light source selected to provide a light output level from said LED-based light source which is undetectable by the human eye but sufficient to heat the light exit element.

13. A system for thermally controlling a lighting device, comprising at least one lighting device according to claim 1, a temperature sensor and/or a timer, and a control means, wherein said temperature sensor and/or said timer is arranged in communication with a control means for thermally controlling the light exit element by means of a control signal associated with a driving power of said LED-based light source.

* * * * *